US006371102B1

(12) United States Patent
Wu et al.

(10) Patent No.: US 6,371,102 B1
(45) Date of Patent: Apr. 16, 2002

(54) DEVICE FOR CUTTING INTERCONNECTED RECTANGULAR PLATE-SHAPED WORKPIECES INTO A PLURALITY OR INDIVIDUAL RECTANGULAR UNITS

(75) Inventors: Kuo-Hwa Wu; Chi-Chien Chien; Shu-Wen Chen; Wei-Chun Seng; Chun-Chen Chen, all of Taichung (TW)

(73) Assignee: Uni-Tek System, Inc., Taichung (TW)

( * ) Notice: Subject to any disclaimer, the term of this patent is extended or adjusted under 35 U.S.C. 154(b) by 0 days.

(21) Appl. No.: 09/651,616

(22) Filed: Aug. 30, 2000

(51) Int. Cl.[7] ..... B28D 7/04

(52) U.S. Cl. ..... 125/35; 125/13.01; 125/13.03; 125/14; 461/397; 461/398

(58) Field of Search ..... 125/13.01, 13.03, 125/14, 35; 451/397, 398

(56) References Cited

U.S. PATENT DOCUMENTS 5,769,297 A * 6/1998 Loomis et al. ..... 225/96.5
6,102,023 A * 8/2000 Ishiwata et al. ..... 125/13.01

* cited by examiner

*Primary Examiner*—Joseph J. Hail, III
*Assistant Examiner*—Shantese McDonald
(74) *Attorney, Agent, or Firm*—Timothy J. Keefer; Wildman, Harrold, Allen & Dixon

(57) ABSTRACT

A device for cutting a row of interconnected rectangular plate-shaped workpieces into a plurality of individual rectangular units, includes a machine bed, and a sliding member disposed slidably on the machine bed and movable along a straight path. A rectangular work seat is disposed rotatably on the sliding member, and is rotatable about a vertical axis on the sliding member. The work seat has four sides, a length and a width. A mounting frame is disposed around the work seat, and defines a rectangular hole therein, which has four sides that are respectively parallel to the four sides of the work seat, and a length and a width that are respectively and slightly larger than those of the work seat. An adhesive sheet has an adhesive top surface with an outer peripheral portion that is adhered to a bottom surface of the mounting frame. The interconnected workpieces are adhered to the top surface of the adhesive sheet so as to be cut while disposed inside the mounting frame. The suction unit sucks and positions the mounting frame on the work seat. When the work seat is rotated by an angle of 90° between two consecutive cutting actions of the cutter, the interconnected workpieces are cut into individual rectangular units.

1 Claim, 4 Drawing Sheets

DEVICE FOR CUTTING INTERCONNECTED RECTANGULAR PLATE-SHAPED WORKPIECES INTO A PLURALITY OR INDIVIDUAL RECTANGULAR UNITS

BACKGROUND OF THE INVENTION

1. Field of the Invention

The invention relates to a cutting device, more particularly to a device for cutting interconnected rectangular plate-shaped workpieces into a plurality of individual rectangular units.

2. Description of the Related Art

Referring to FIGS. 1 and 2, a conventional cutting device for cutting interconnected rectangular plate-shaped workpieces 6, such as interconnected electronic packages like CPU, RAM, DRAM, transistor etc., into a plurality of individual rectangular units is shown to include a machine bed 100, a sliding member 1 that is disposed slidably on the machine bed 100 and that is movable along a straight line, a circular work seat 2, an annular mounting frame 5, an adhesive sheet 500, a suction unit 7, a sensing device 3, and a cutter 4.

As illustrated, the work seat 2 is disposed rotatably on the sliding member 1, and is rotatable about a vertical axis on the sliding member 1.

The mounting frame 5 is disposed around the work seat 2, and defines a circular hole 503 therein.

The adhesive sheet 500 has an adhesive top surface with an outer peripheral portion that is adhered to a bottom surface 501 of the mounting frame 5. The interconnected workpieces 6 are adhered on the top surface of the adhesive sheet 500 so as to be cut into individual rectangular units when the work seat 2 is moved along the straight path to a position, where the work seat 2 is detected by the sensing device 3 so as to activate the cutter 4 to perform the cutting operation on the interconnected workpieces 6.

The suction unit 7 sucks and positions the mounting frame 5 on the work seat 2.

When the work seat 2 is rotated by an angle of 90° between two consecutive cutting actions of the cutter 4, the interconnected workpieces 6 are cut into a plurality of individual rectangular units.

A drawback that results from use of the aforesaid conventional cutting device is as follows:

Because the adhesive top surface of the adhesive sheet 500 is in the shape of a circle, after the interconnected workpieces 6 are disposed thereon, four sector-shaped spaces are formed around, and are not occupied by the interconnected workpieces 6, thereby resulting in non-efficient use of the adhesive sheet 500 and in a reduced production rate.

SUMMARY OF THE INVENTION

Therefore, the object of this invention is to provide a cutting device having a work seat and a mounting frame of specific configurations such that the aforesaid drawback of the conventional cutting device can be avoided.

Accordingly, a cutting device of the present invention is adapted for cutting rectangular interconnected plate-shaped workpieces into a plurality of individual rectangular units. The device includes a machine bed, a sliding member, a horizontal rectangular work seat, an annular mounting frame, an adhesive sheet, a suction unit, and a cutter. The sliding member is mounted slidably on the machine bed, and is movable along a straight path. The work seat is disposed rotatably on the sliding member, and is rotatable about a vertical axis on the sliding member. The work seat has four sides, a length and a width. The mounting frame is disposed around the work seat, and defines a rectangular hole therein, which has four sides that are respectively parallel to the four sides of the work seat, and a length and a width that are respectively and slightly larger than those of the work seat. The mounting frame has a bottom surface. The adhesive sheet has an adhesive top surface with an outer peripheral portion that is adhered to the bottom surface of the mounting frame. The adhesive top surface is adapted for adhesion of the interconnected workpieces to be cut thereon. The suction unit sucks and positions the mounting frame on the work seat. The cutter is adapted to cut the interconnected workpieces on the work seat. When the work seat is rotated by an angle of 90° between two consecutive cutting actions of the cutter, the interconnected workpieces are cut into a plurality of individual rectangular units.

BRIEF DESCRIPTION OF THE DRAWINGS

These and other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 3:
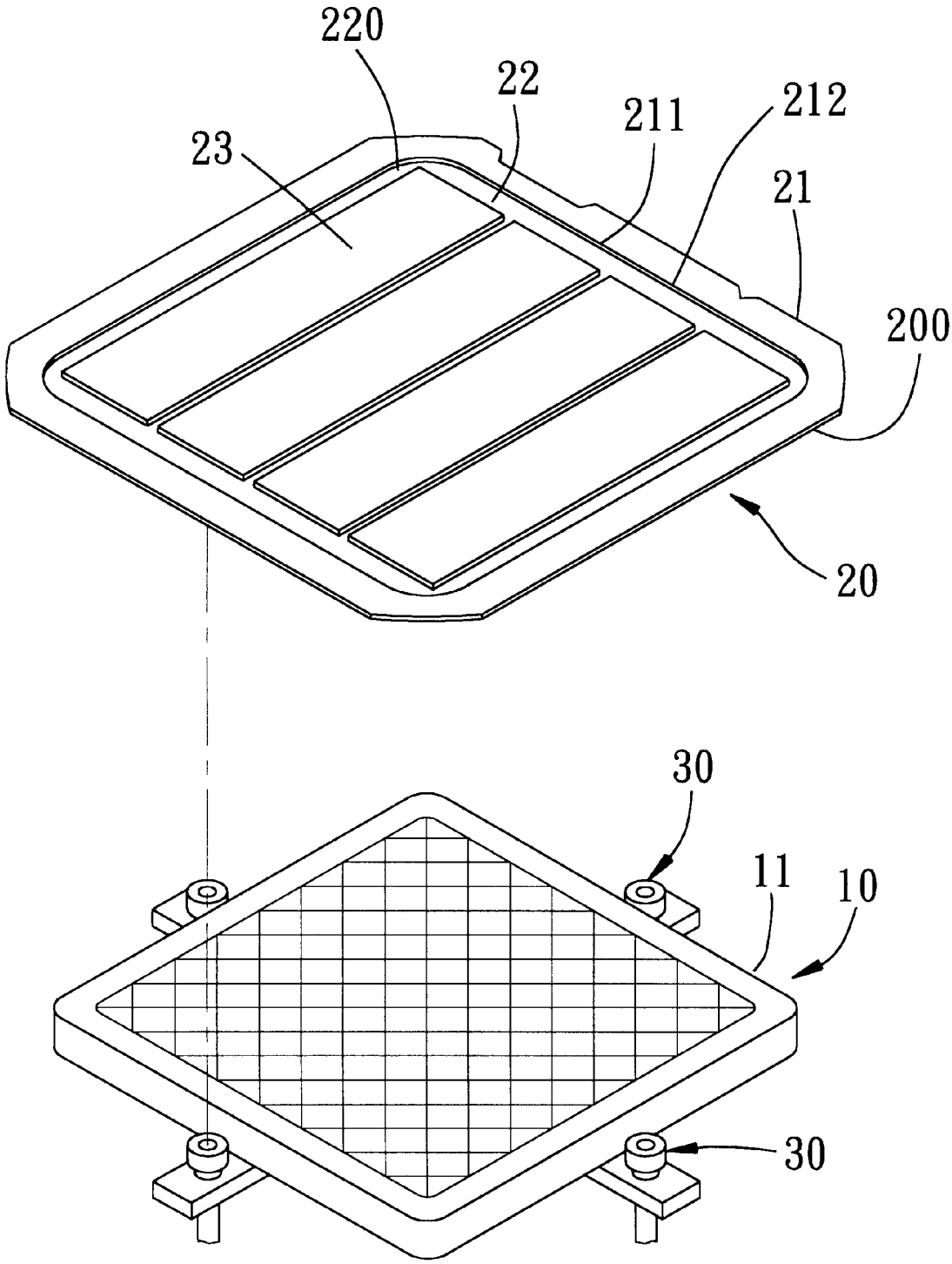
FIG. 3 illustrates a rectangular work seat, an adhesive sheet and a horizontal mounting frame employed in the preferred embodiment of a cutting device of the present invention.
Figure 4:
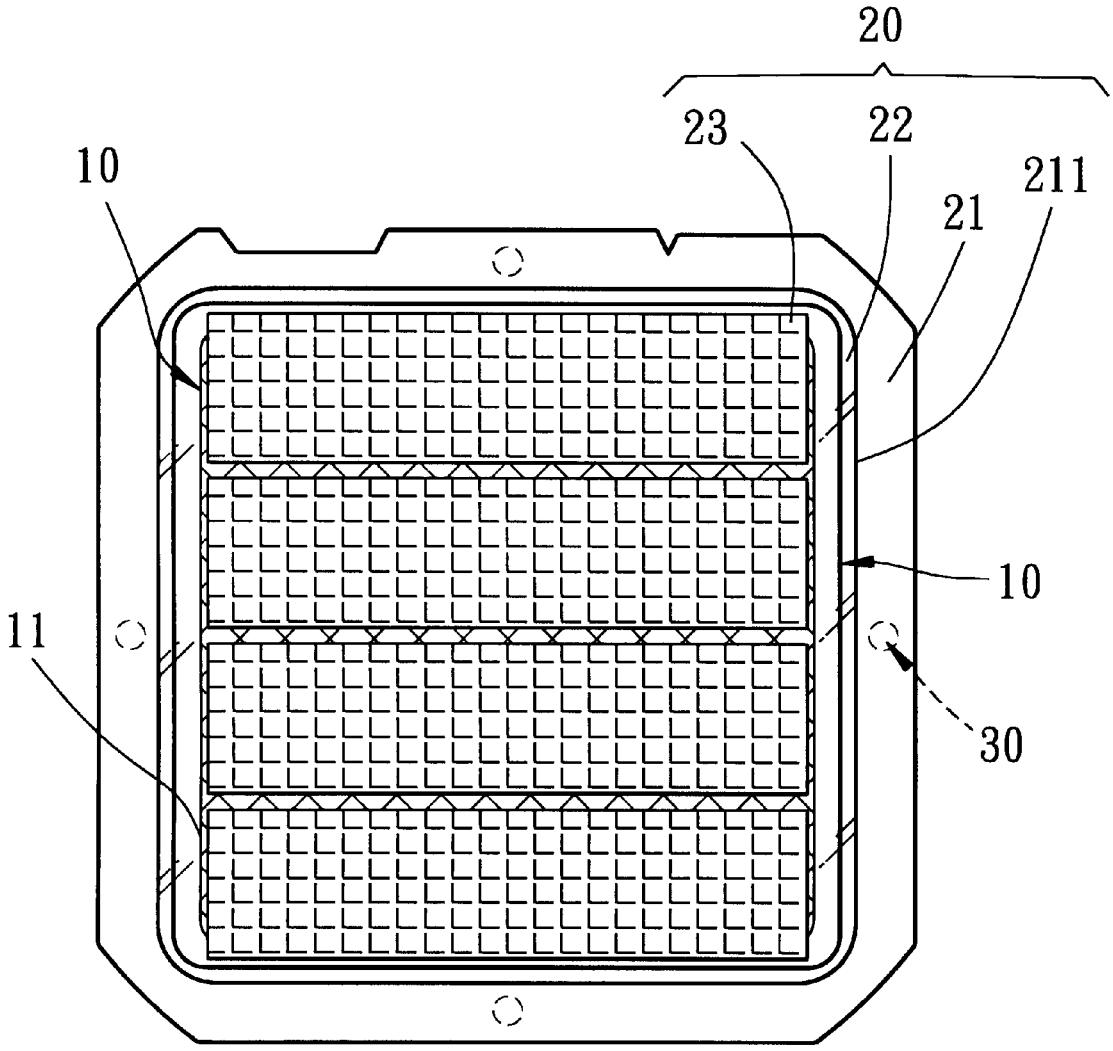
FIG. 4 illustrates how four interconnected plate-shaped workpieces are mounted on the work seat by the use of the horizontal mounting frame and the adhesive sheet in the preferred embodiment.

Referring to FIGS. 3 and 4, the cutting device of the present invention is adapted for cutting interconnected rectangular plate-shaped workpieces 23 into a plurality of individual rectangular units, and includes a machine bed (not shown), a sliding member (not shown), a rectangular work seat 10, a rectangular mounting frame 20, an adhesive sheet 22, a suction unit 30, and a cutter (not shown).

Figure 1:
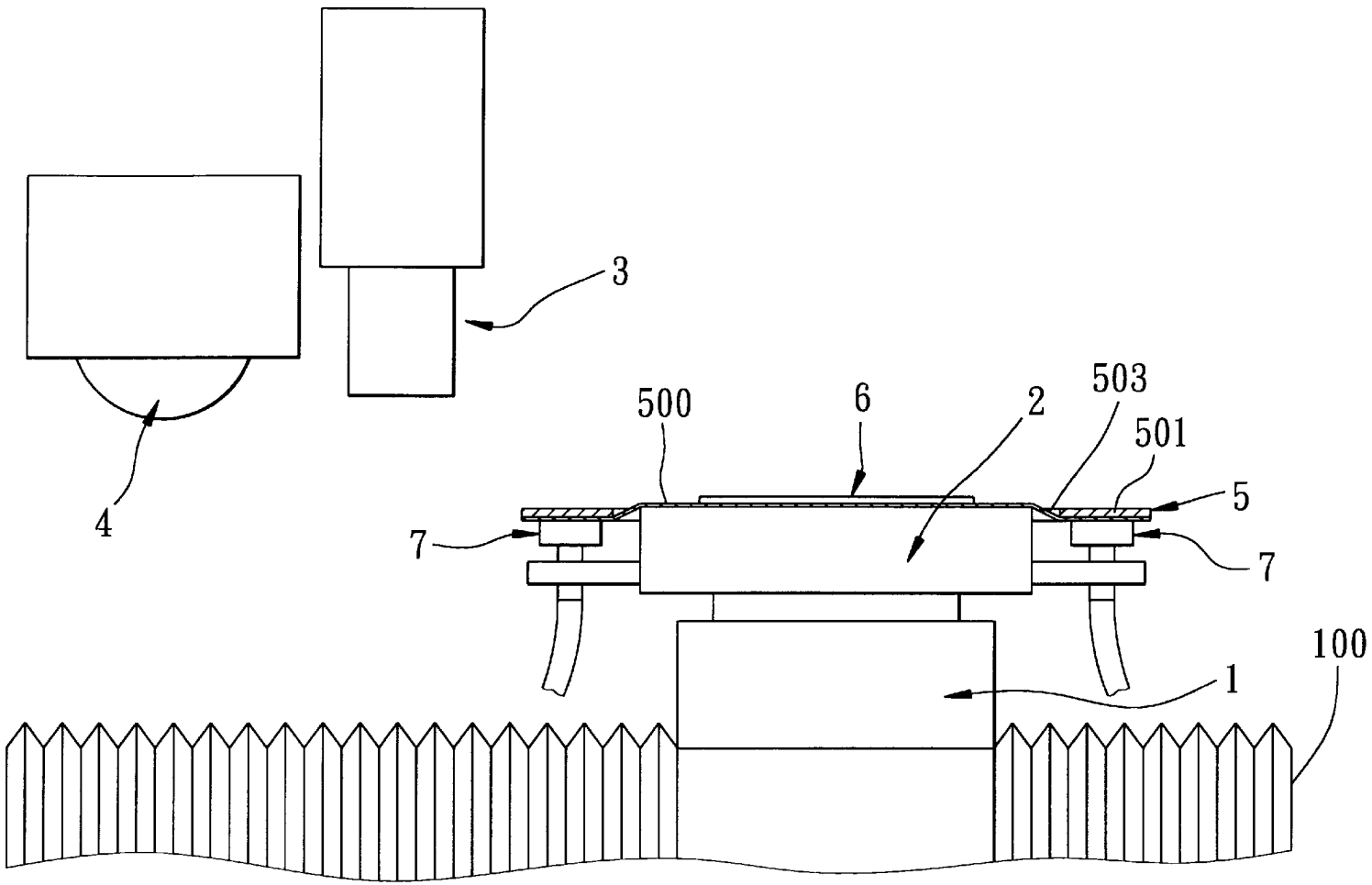
FIG. 1 PRIOR ART
FIG. 1 is a schematic side view of a conventional cutting device.
Figure 2:
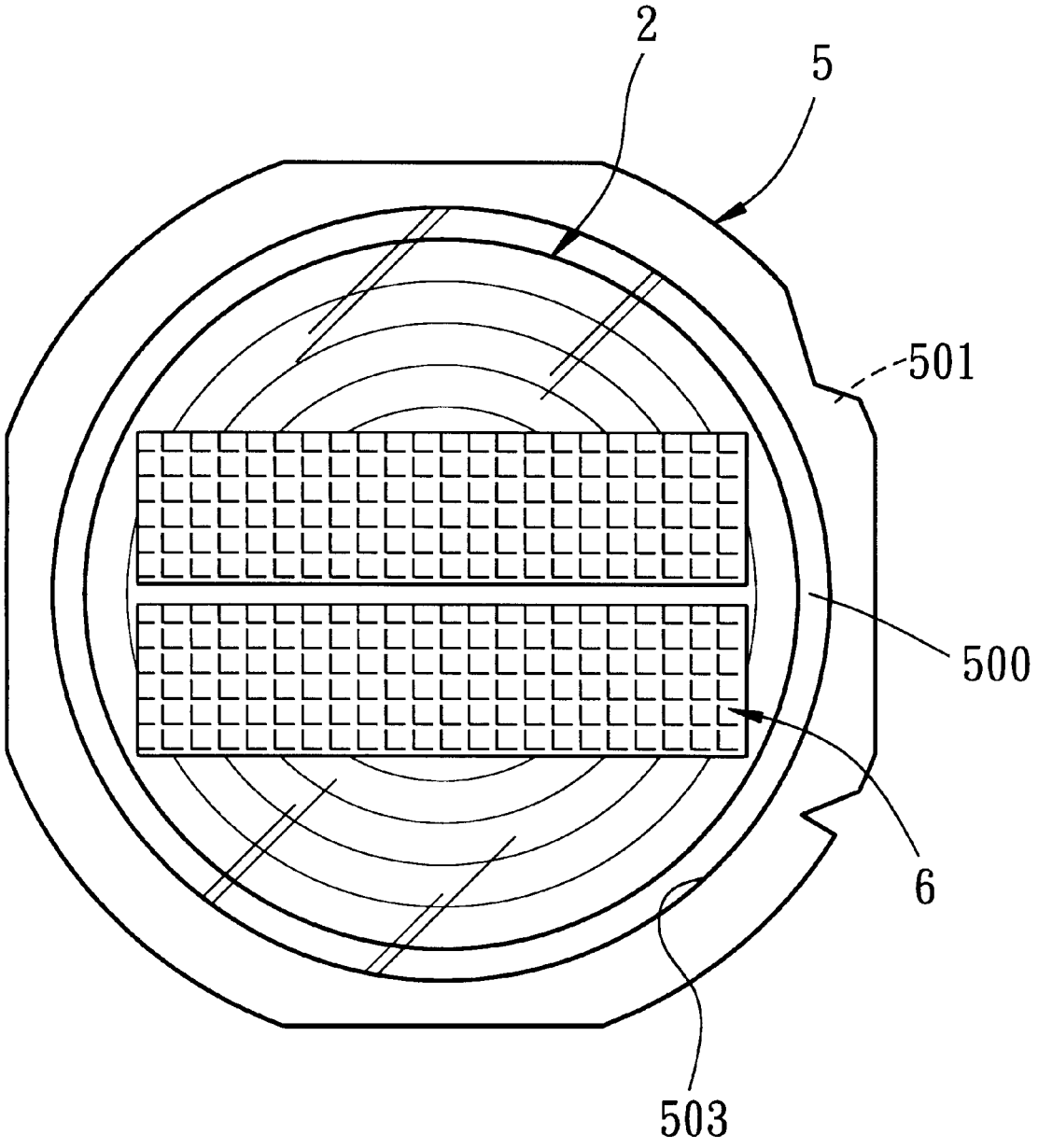
FIG. 2 PRIOR ART
FIG. 2 is a top view of the conventional cutting device, illustrating how two interconnected plate-shaped workpieces is mounted on the conventional cutting device so as to undergo a cutting operation.

Since the structures of the machine bed, the sliding member, the suction unit, the adhesive sheet 22 and the cutter are the same as those described in the conventional cutting device shown in FIGS. 1 and 2, and since the features of the present invention are not pertinent thereto, a detailed description thereof will be omitted herein for the sake of brevity.

As illustrated, the rectangular work seat 10 is adapted to be disposed rotatably on the sliding member (not shown) in a conventional manner such that the work seat 10 is rotatable about a vertical axis on the sliding member (not shown). The work seat 10 has four sides 11, a length and a width.

The mounting frame 20 is disposed around the work seat 10, and defines a rectangular hole 211 therein, which has four sides 212 that are respectively parallel to the sides 11 of the work seat 10, and a length and a width that are respectively and slightly larger than those of the work seat 10. The mounting frame 20 has a bottom surface 200.

The adhesive sheet 22 has an adhesive top surface 220 with an outer peripheral portion that is adhered to the bottom surface 200 of the mounting frame 20. The interconnected workpieces 23 are adhered to the top surface 220 of the adhesive sheet 22 inside the mounting frame 20 so as to be cut by the cutter (not shown) when the mounting frame 20 is moved along the straight path by virtue of movement of the sliding member (not shown).

The suction unit 30 includes four elements provided at four sides of the work seat 10 for sucking and positioning the mounting frame 20 on the work seat 10.

When the work seat 10 is rotated by an angle of 90° between two consecutive cutting actions of the cutter, the interconnected workpieces 23 are cut into a plurality of individual rectangular units. Since the rotation and cutting operations of the cutter (not shown) are known in the art, and since the features of the present invention do not reside therein, a detailed description of the same is omitted herein for the sake of brevity.

Because the rectangular work seat 10 and the rectangular mounting frame 20 are used to support the interconnected rectangular workpieces 23, the areas of the work seat 10 and the mounting frame 20 are efficiently used, thereby increasing the production rate. Since the interconnected workpieces 23 occupy a relatively large area of the adhesive sheet 22, a smaller number of adhesive sheets is required in comparison to the conventional cutting device when cutting the same amount of workpieces, thereby resulting in lesser waste of the adhesive sheets 22 and increasing the production rate. The object is the present invention is thus achieved.

The cutting device of the present invention is not limited to the wafer cutting, and can be utilized for cutting LED (Gallium Arsenide), ceramic, glass plate, stones, silicon wafer, etc.

With this invention thus explained, it is apparent that numerous modifications and variations can be made without departing from the scope and spirit of this invention. It is therefore intended that this invention be limited only as indicated by the appended claims.

We claim:

1. A device for cutting interconnected rectangular plate-shaped workpieces into a plurality of individual rectangular units, comprising:

a machine bed;

a sliding member mounted slidably on said machine bed, and movable along a straight path;

a rectangular work seat disposed rotatably on said sliding member and rotatable about a vertical axis on said sliding member, said work seat having four sides, a length and a width;

a rectangular mounting frame disposed around said work seat and defining a rectangular hole therein, which has four sides that are respectively parallel to said four sides of said work seat, and a length and a width that are respectively and slightly larger than those of said work seat, said mounting frame having a bottom surface;

an adhesive sheet having an adhesive top surface with an outer peripheral portion that is adhered to said bottom surface of said mounting frame, said adhesive top surface being adapted for adhesion of the interconnected workpieces to be cut thereon;

a suction unit for sucking and positioning said mounting frame on said work seat; and a cutter adapted to cut the interconnected workpieces on said work seat;

whereby, when said work seat is rotated by an angle of 90° between two consecutive cutting actions of said cutter, the interconnected rectangular plate-shaped workpieces can be cut into a pluarality of individual rectangular units.

* * * * *

UNITED STATES PATENT AND TRADEMARK OFFICE

CERTIFICATE OF CORRECTION

PATENT NO. : 6,371,102 B1
DATED : April 16, 2002
INVENTOR(S) : Kuo-Hwa Wu et al.

It is certified that error appears in the above-identified patent and that said Letters Patent is hereby corrected as shown below:

Title page,
Item [54], Title, change "OR" to -- OF --.

Signed and Sealed this

First Day of October, 2002

*Attest:*

*Attesting Officer*

JAMES E. ROGAN
*Director of the United States Patent and Trademark Office*